US008882103B2

(12) United States Patent
Samoto

(10) Patent No.: US 8,882,103 B2
(45) Date of Patent: Nov. 11, 2014

(54) IMAGE RECORDING APPARATUS WITH IMPROVED OUTER APPEARANCE

(71) Applicant: Kenji Samoto, Nagoya (JP)

(72) Inventor: Kenji Samoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/037,295

(22) Filed: Sep. 25, 2013

(65) Prior Publication Data

US 2014/0167348 A1 Jun. 19, 2014

(30) Foreign Application Priority Data

Dec. 14, 2012 (JP) ..... 2012-273765

(51) Int. Cl.
*B65H 1/00* (2006.01)
*B65H 1/26* (2006.01)

(52) U.S. Cl.
CPC . *B65H 1/266* (2013.01); *B65H 1/00* (2013.01)
USPC ..... 271/171; 271/145

(58) Field of Classification Search
USPC ..... 271/145, 171; 399/393
See application file for complete search history.

(56) References Cited

U.S. PATENT DOCUMENTS

| | | | | |
|---|---|---|---|---|
| 5,040,856 | A | 8/1991 | Wilkins et al. | |
| 5,413,409 | A * | 5/1995 | Arai | 312/330.1 |
| 6,443,545 | B1 | 9/2002 | Woerner | |
| 7,472,904 | B2 | 1/2009 | Park | |
| 7,591,464 | B2 * | 9/2009 | Mizobe | 271/160 |
| 7,862,034 | B2 * | 1/2011 | Kobayashi | 271/145 |
| 8,272,637 | B2 * | 9/2012 | Asada et al. | 271/171 |
| 8,528,896 | B2 * | 9/2013 | Miwa | 271/145 |
| 2004/0190934 | A1 * | 9/2004 | Okabe | 399/111 |
| 2004/0218952 | A1 * | 11/2004 | Teo et al. | 399/393 |
| 2012/0001378 | A1 * | 1/2012 | Izuchi et al. | 271/9.11 |
| 2013/0140762 | A1 | 6/2013 | Washino et al. | |
| 2013/0341853 | A1 * | 12/2013 | Hsu | 271/145 |

FOREIGN PATENT DOCUMENTS

| | | |
|---|---|---|
| JP | 2011-051665 A | 3/2011 |
| JP | 2013-116798 A | 6/2013 |

* cited by examiner

*Primary Examiner* — Ernesto Suarez

(74) *Attorney, Agent, or Firm* — Baker Botts L.L.P.

(57) ABSTRACT

An image recording apparatus including: a sheet tray; a drawing portion; and a first stop portion. The sheet tray is inserted into and pulled out from an accommodating portion along an inserting direction. A main tray of the sheet tray is positioned at a first position and at a second position located downstream of the first position in the inserting direction as a result of movement of the main tray in the inserting direction. An extension tray of the sheet tray is movable relative to the main tray. The drawing portion draws the main tray from the first position into the second position. The first stop portion is disposed in the accommodating portion and abuttable against the extension tray when the main tray is located downstream of the first position in the inserting direction to restrict movement of the extension tray in the inserting direction.

14 Claims, 10 Drawing Sheets

IMAGE RECORDING APPARATUS WITH IMPROVED OUTER APPEARANCE

CROSS REFERENCE TO RELATED APPLICATION

This application claims priority from Japanese Patent Application No. 2012-273765 filed Dec. 14, 2012. The entire content of the priority application is incorporated herein by reference.

TECHNICAL FIELD

The present invention relates to an image recording apparatus having a sheet tray that can be pulled out from and inserted into a casing and can support a sheet therein, and configured to record an image onto the sheet fed from the sheet tray.

BACKGROUND

In recent years, improvement of an outer appearance of a casing, for example, flattening of an outer surface of the casing, is often required in terms of design of an image recording apparatus.

There is known an image recording apparatus having a cassette cover attached to a sheet tray through a coil spring. In a state where the sheet tray is mounted in the image recording apparatus, the cassette cover is attached to a body cover of a main casing to make a surface of the cassette cover and a surface of the body cover flush with each other. Moreover, in a case where the cassette cover is attached to the body cover, the coil spring biases the sheet tray toward the back side of the image recording apparatus. This allows the sheet tray to be mounted at a position at which a sheet placed on the sheet tray can be fed to an inside of the image recording apparatus.

SUMMARY

However, in the above-described image recording apparatus, the sheet tray and the cassette cover are connected to each other through the coil spring, so that the following problem is caused. That is, even if the cassette cover is pulled when the sheet tray is pulled out from the image recording apparatus, the sheet tray itself cannot be pulled out until the coil spring is fully stretched, which degrades operability of the sheet tray.

In view of the foregoing, it is an object of the present invention to provide a mechanism that allows a sheet tray to be smoothly pulled out from a casing of an apparatus while achieving a desired outer appearance which is formed by the sheet tray and the casing.

In order to attain the above and other objects, the present invention provides an image recording apparatus including: a casing; a sheet tray; a recording section; a drawing portion; and a first stop portion. The casing defines a accommodating portion therein and has an opening through which the accommodating portion is open to an outside. The sheet tray is configured to be inserted into the accommodating portion in an inserting direction through the opening and to be pulled out from the accommodating portion in a pulling direction opposite to the inserting direction through the opening. The sheet tray includes: a main tray and an extension tray. The main tray is configured to support a recording sheet. The main tray is configured to be positioned at a first position and at a second position as a result of movement of the main tray in the inserting direction. The main tray has an upstream portion in the inserting direction. The extension tray is configured to be moved relative to the main tray in the inserting direction and in the pulling direction. The extension tray is configured to be pulled out from the upstream portion to support a recording sheet in combination with the main tray. The recording section is configured to record an image on a recording sheet fed from the sheet tray. The drawing portion is configured to draw the main tray from the first position into the second position. The second position is located downstream of the first position in the inserting direction and allows the recording sheet supported at the sheet tray to be fed to the recording section. The first stop portion is disposed in the accommodating portion and configured to abut against the extension tray in a state where the main tray is located at a position downstream of the first position in the inserting direction to restrict movement of the extension tray in the inserting direction.

BRIEF DESCRIPTION OF THE DRAWINGS

In the drawings;

FIGS. 3A and 3B are each a perspective view of a part of a casing, in which FIG. 3A illustrates a state where an outer cover is mounted to the casing, and FIG. 3B illustrates a state where the outer cover is removed from the casing;

FIGS. 4A and 4B are each a perspective view of a sheet feeding tray, in which FIG. 4A illustrates a state where an upper side of the sheet feeding tray is covered by a discharge tray, and FIG. 4B illustrates a state where the upper side of the sheet feeding tray is exposed to an outside;

DETAILED DESCRIPTION

Figure 1:
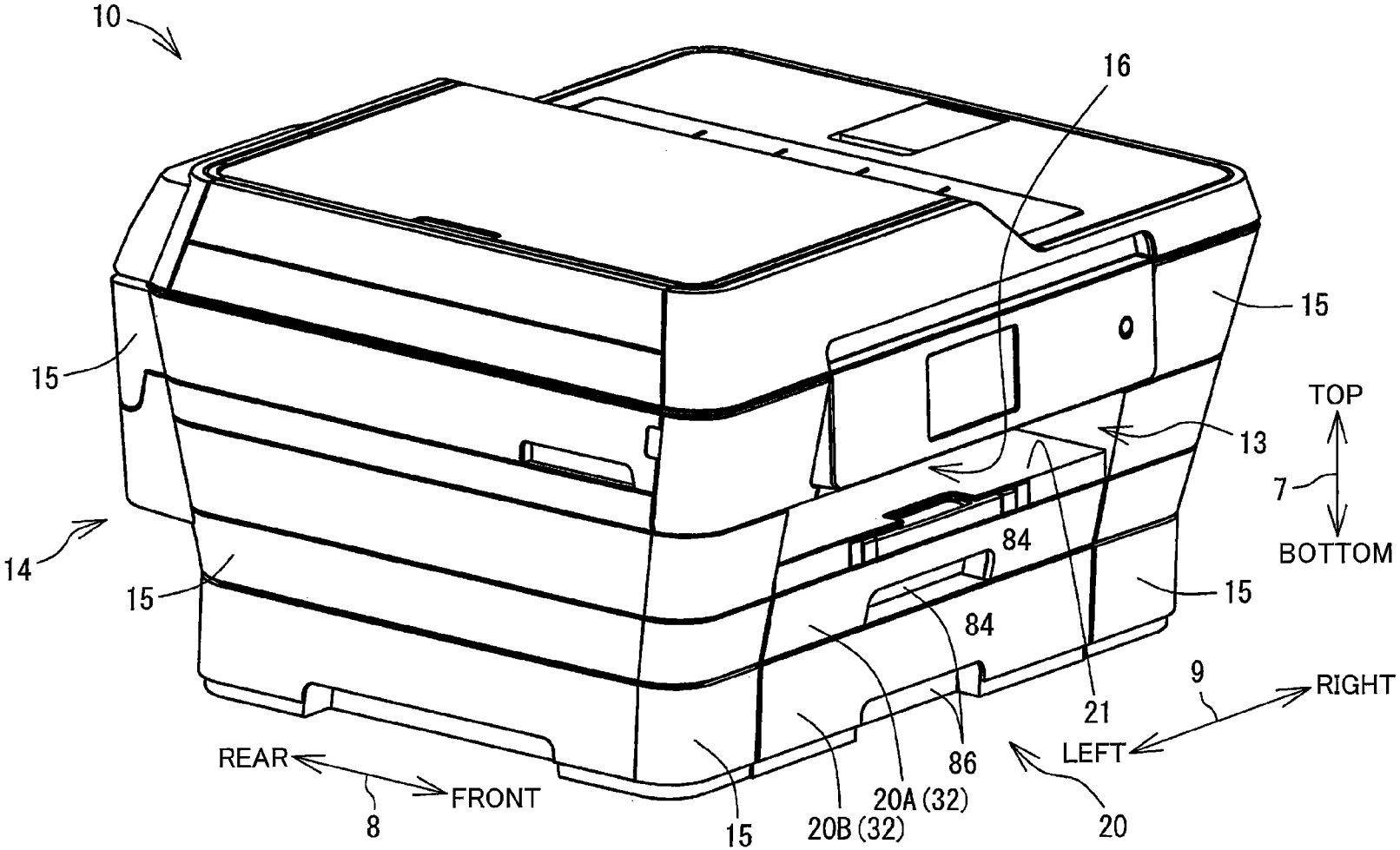
FIG. 1 is a perspective view of a multifunction device according to one embodiment of the present invention.

A multifunction device as an image recording apparatus according to one embodiment of the present invention will be described with reference to FIGS. 1 through 8B. Throughout the specification, the terms "upper", "lower", "above", "below", "beneath", "right", "left", "front", "rear" and the like will be used assuming that the multifunction device 10 is disposed in an orientation in which it is intended to be used. In the following description, movement directed from an origin of an arrow to an end point thereof is represented using a suffix "ward" (for example, forward, rearward, upward, downward, leftward, rightward) and movement from the origin to the end point and vice versa is represented using a word "direction" (for example, front-rear direction, upper-lower direction, left-right direction). More specifically, in the following description, an upper-lower direction 7 is defined with reference to an operable state of the multifunction device 10 (i.e. a state illustrated in FIG. 1), a front-rear direction 8 is defined with a side at which an opening 13 is formed as a front side (near side), and a left-right direction 9 is defined with reference to the front side of the multifunction device 10.

[Overall Structure of Multifunction Device 10]

As illustrated in FIG. 1, the multifunction device 10 is formed in substantially a rectangular parallelepiped shape and has a casing 14 (see also FIG. 3B) covered by a plurality of outer covers 15 (described later). The multifunction device 10 has various functions, such as a facsimile function and a printer function. The printer function is a function that records an image onto a recording sheet 12 (see FIG. 2).

As illustrated in FIG. 1, the opening 13 is formed on the front side of the casing 14. An accommodating portion 16 (described later) is formed at a rear side of the opening 13. That is, the accommodating portion 16 communicates with an outside of the casing 14 through the opening 13. A plurality of sheet feeding trays 20 (described later) that can each support the recording sheets 12 stacked thereon is each configured to be slidingly moved relative to the casing 14 in the front-rear direction 8 and can thus each be pulled out from and inserted into the casing 14 through the opening 13. Each sheet feeding tray 20 is inserted into the casing 14 through the opening 13 and accommodated in the accommodating portion 16 (see FIG. 1), that is, mounted in the casing 14. In FIG. 1, the sheet feeding trays 20 includes upper and lower tiers and, in the following description, only an upper sheet feeding tray 20A will be described in detail, while detailed descriptions of a lower sheet feeding tray 20B will be omitted. That is, in this embodiment, the lower sheet feeding tray 20B has basically the same configuration as that of the upper sheet feeding tray 20A except that a discharge tray 21 is provided only at the upper sheet feeding tray 20A.

Figure 2:
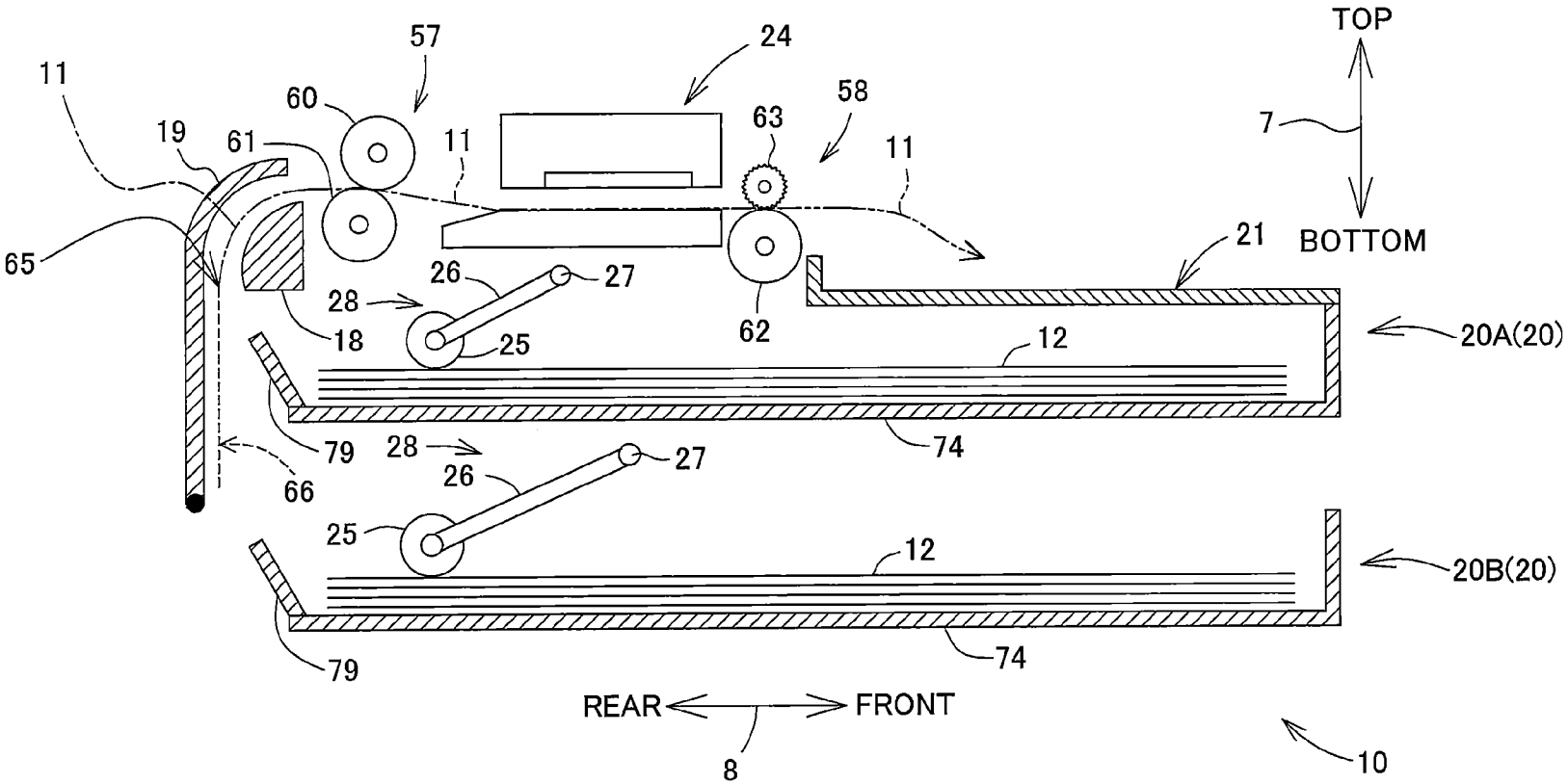
FIG. 2 is a schematic vertical cross-sectional view illustrating an inner structure of the multifunction device.
Figure 3B:
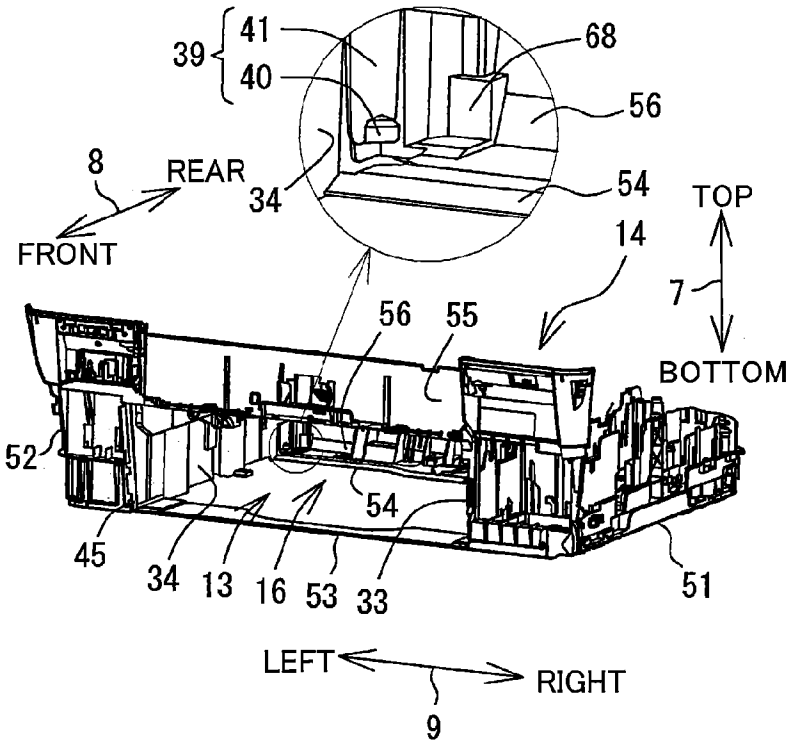
Figure 3A:
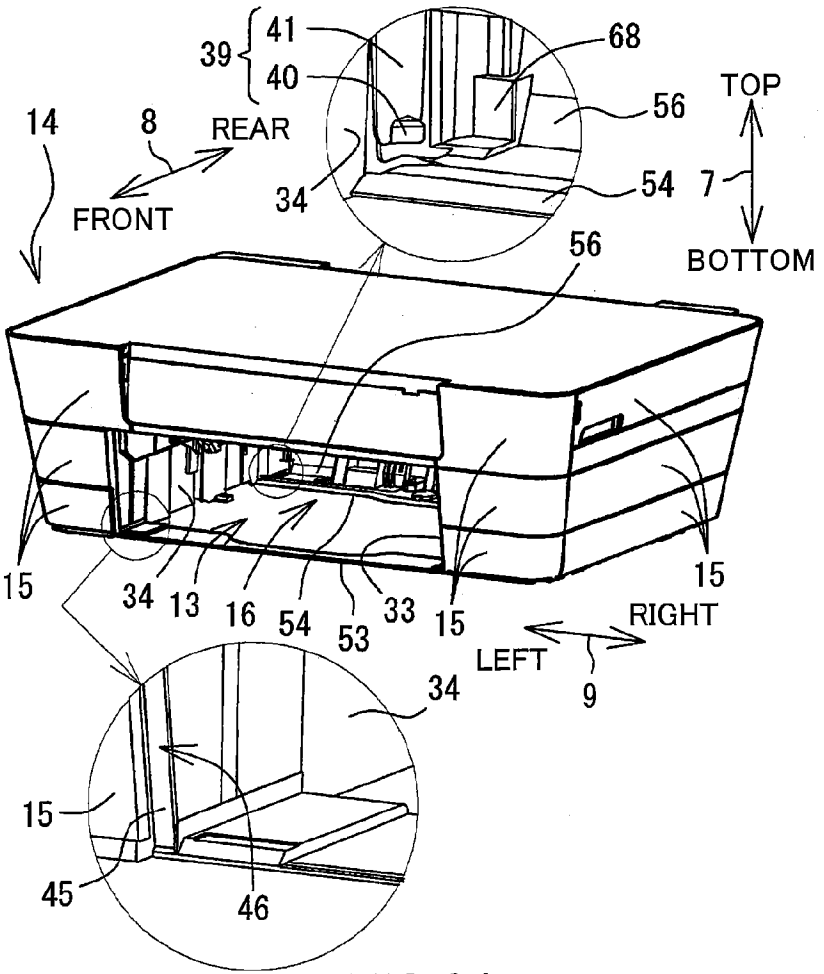

Incidentally, in the drawings, FIG. 2 schematically illustrates an internal structure of the multifunction device 10. FIGS. 3A and 3B each illustrate only a portion around the accommodating portion 16 in which the upper sheet feeding tray 20A is mounted. FIGS. 4A, 4B, 5, and 6 each illustrate the upper sheet feeding tray 20A. FIGS. 7A and 7B each illustrate only the upper sheet feeding tray 20A and a portion of the casing 14 around the accommodating portion 16 in which the upper sheet feeding tray 20A is mounted.

As illustrated in FIG. 2, a sheet feeding section 28, a conveyer roller pair 57, a discharge roller pair 58, and a recording section 24 are disposed inside the casing 14.

In a state where the upper sheet feeding tray 20A is accommodated in the accommodating portion 16 of the casing 14, the recording sheet 12 placed on the upper sheet feeding tray 20A is conveyed along a conveying path 65 (described later) by the sheet feeding section 28 and then by the conveyer roller pair 57. The conveyed recording sheet 12 is subjected to image recording by the recording section 24. The recording sheet 12 on which the image has been recorded is discharged by the discharge roller pair 58 to the discharge tray 21 and then placed on the discharge tray 21. That is, the discharge tray 21 supports the recording sheet 12. The discharge tray 21 is provided above the upper sheet feeding tray 20A. The discharge tray 21 is configured to be slidingly moved in the front-rear direction 8 together with the upper sheet feeding tray 20A.

The sheet feeding section 28 is provided above the upper sheet feeding tray 20A which is in a state of being accommodated in the accommodating portion 16. The sheet feeding section 28 includes a sheet feeding roller 25, an arm 26, and a shaft 27. The sheet feeding roller 25 is rotatably provided at a free end (rear end) of the arm 26. The arm 26 is pivotally movable about an axis of the shaft 27 supported at the casing 14. The arm 26 is pivotally movably biased toward the upper sheet feeding tray 20A by its own weight or a biasing force of a spring (not illustrated). The sheet feeding roller 25 receives a drive force from a motor (not illustrated) to be rotated, picks up the recording sheet 12 placed on the upper sheet feeding tray 20A, and feeds the recording sheet 12 to the conveying path 65. When the upper sheet feeding tray 20A is inserted into and removed from the casing 14, an extending portion (not illustrated) extending from a base end of the arm 26 either rightward or leftward in the left-right direction 9 abuts against a side plate 75 (see FIG. 4A) provided at a main tray 31 of the upper sheet feeding tray 20A, causing the arm 26 to be pivotally moved upward. This allows the insertion and removal of the upper sheet feeding tray 20A to be accomplished without being interrupted by the sheet feeding section 28.

Incidentally, the recording sheet 12 placed on the lower sheet feeding tray 20B is conveyed in a similar manner to that placed on the upper sheet feeding tray 20A. The recording sheet 12 placed on the lower sheet feeding tray 20B is fed by the sheet feeding section 28 to be conveyed toward the conveying path 65 through a second conveying path 66 which merges with the conveying path 65. The recording sheet 12 fed to the second conveying path 66 is then conveyed along the conveying path 65 by the conveyer roller pair 57 for image recordation by the recording section 24.

The conveying path 65 extends from a rear end portion of the upper sheet feeding tray 20A which is in a state of being mounted in the casing 14. The conveying path 65 is defined by an inner guide member 18 and an outer guide member 19, and has a curved part and a straight part (note that only the curved part is illustrated in FIG. 2). The recording sheet 12 placed on the upper sheet feeding tray 20A is conveyed upward in a U-turn manner along the curved part, then conveyed along the straight part, and reaches the recording section 24. The recording sheet 12 on which an image has been recorded by the recording section 24 is conveyed along the straight part to be discharged to the discharge tray 21. That is, the recording sheet 12 is conveyed along the conveying path 65 in a conveying direction 11 denoted by a dashed arrow of FIG. 2.

At the conveying path 65, the conveyer roller pair 57 including a conveyer roller 60 and a pinch roller 61 is disposed upstream of the recording section 24 in the conveying direction 11, and the discharge roller pair 58 including a discharge roller 62 and a spur roller 63 is disposed downstream of the recording section 24 in the conveying direction 11. The conveyer roller pair 57 nips the recording sheet 12 between the conveyer roller 60 and the pinch roller 61. The discharge roller pair 58 nips the recording sheet 12 between the discharge roller 62 and the spur roller 63. The conveyer roller 60 and the discharge roller 62 each receive a drive force from a motor (not illustrated) to be rotated. As a result, the conveyer roller pair 57 and the discharge roller pair 58 each convey the nipped recording sheet 12 in the conveying direction 11.

The recording section 24 is disposed above the conveying path 65. In the present embodiment, the recording section 24 records, by an inkjet recording method, an image on the recording sheet 12 which is fed to the conveying path 65 by the sheet feeding section 28 and then conveyed along the conveying path 65 by the conveyer roller pair 57. A method for the recording section 24 to record an image on the recording sheet 12 is not limited to the inkjet recording method, but may be any other known methods such as an electrophotographic recording method.

[Casing 14]

The casing 14, a part of which is illustrated in FIG. 3B, serves to form a framework of the multifunction device 10. The casing 14 is obtained by combining a plurality of plate-like and bar-like metal and resin materials. The casing 14 includes a right frame 51, a left frame 52, a front bottom frame 53, a rear bottom frame 54, an upper frame 55, and a rear frame 56. The front bottom frame 53 connects lower front edges of the right and left frames 51 and 52. The rear bottom frame 54 connects lower rear edges of the right and left frames 51 and 52. The upper frame 55 connects upper front edges of the right and left frames 51 and 52. The rear frame 56 stands substantially vertically from the rear bottom frame 54, and has left and right end portions at which main tray stop portions 68 are formed respectively. Each main tray stop portion 68 is a surface extending both in the upper-lower direction 7 and in the left-right direction 9.

As illustrated in FIG. 3A, the outer cover 15 is mounted to a surface of the casing 14 such that the casing 14 is covered by the outer cover 15. In the present embodiment, the outer cover 15 is formed of a resin. Moreover, in the present embodiment, the plurality of outer covers 15 is mounted to the casing 14. That is, one outer cover 15 is mounted to the casing 14 such that a part of the casing 14 is covered by the one outer cover 15.

The outer cover 15 has a mounting portion (not illustrated) on a side thereof confronting the casing 14 when being mounted. Using this mounting portion, the outer cover 15 is mounted to the casing 14 by being engaged with the casing 14 or fixed to the casing 14 by a screw. That is, the mounting portion is formed on the casing 14 side of the outer cover 15 when being mounted and also formed as a protrusion or a groove to be engaged with the casing 14, or as a screw hole through which a screw is inserted.

A side of the outer cover 15 opposite to the casing 14 side when being mounted is formed in substantially a flat surface. As illustrated in FIG. 3A, in a state where the plurality of outer covers 15 are mounted to the casing 14, outer surfaces (front surface, rear surface, side surfaces, upper surface) of the multifunction device 10 are substantially flush with one another.

In the present embodiment, the plurality of outer covers 15 and tray covers 84 (see FIG. 1, described later) are substantially flush with one another on all outer surfaces of the multifunction device 10. However, the outer covers 15 and the tray covers 84 need not always be flush with one another as long as a desired outer appearance of the multifunction device 10 can be obtained. The desired outer appearance is, for example, a state where the outer covers 15 and the tray covers 84 are arranged in a certain rule (e.g., concavity and convexity are formed at a regular interval) to make the outer appearance of the multifunction device 10 look good.

[Accommodating Portion 16]

The accommodating portion 16 is formed on the rear side of the opening 13. The accommodating portion 16 is formed in a space inside the casing 14. As illustrated in FIGS. 3A and 3B, in the accommodating portion 16 for accommodating the upper sheet feeding tray 20A therein, a lower side thereof is defined by the front bottom frame 53 and the rear bottom frame 54, an upper side thereof is defined by the upper frame 55, the right side thereof is defined by the right frame 51, a left side thereof is defined by the left frame 52, and a rear side thereof is defined by the rear frame 56.

An interval between the right frame 51 and the left frame 52 is slightly greater than a length of the upper sheet feeding tray 20A in the left-right direction 9. An interval between the upper frame 55, and the front bottom frame 53 and the rear bottom frame 54 is slightly greater than a length of the upper sheet feeding tray 20A in the upper-lower direction 7. An interval between the opening 13 and the rear frame 56 is substantially the same as a length of the upper sheet feeding tray 20A in the front-rear direction 8. With the above configuration, the upper sheet feeding tray 20A can be inserted into the accommodating portion 16 through the opening 13 and accommodated in the accommodating portion 16.

[Sheet Feeding Tray 20]

As illustrated in FIG. 2, the upper sheet feeding tray 20A is disposed below the recording section 24 in a state being mounted in the casing 14. In the state where the upper sheet feeding tray 20A is mounted in the casing 14, the recording sheet 12 placed on the upper sheet feeding tray 20A can be supplied to the conveying path 65. On the other hand, when the upper sheet feeding tray 20A is removed from the casing 14, replenishment of the recording sheets 12 to the upper sheet feeding tray 20A can be accomplished. As illustrated in FIGS. 4A, 4B, 5, and 6, the upper sheet feeding tray 20A includes the main tray 31 and an extension tray 32. Although a discharge auxiliary tray 22 pulled out from the discharge tray 21 is illustrated in FIGS. 5 and 6, detailed description thereof is omitted here.

[Main Tray 31]

As illustrated in FIGS. 4A, 4B, 5, and 6, the main tray 31 includes a bottom plate 74, a pair of side plates 75, a pair of center plates 76, a rear right plate 77, and a rear left plate 78. The pair of side plates 75 extends vertically upward from both left and right end portions of the bottom plate 74. The pair of center plates 76 extends vertically upward from a center portion of a rear end of the bottom plate 74 in the left-right direction 9. The rear right plate 77 extends vertically upward from a rear right end of the bottom plate 74. The rear left plate 78 extends vertically upward from a rear left end of the bottom plate 74.

The recording sheet 12 is placed on the bottom plate 74. That is, the bottom plate 74 supports the recording sheet 12. The center plates 76 each abut against the recording sheet 12 moving rearward. This prevents the recording sheet 12 from dropping from the rear side of the upper sheet feeding tray 20A in a state where the upper sheet feeding tray 20A is removed from the casing 14. In a state where the upper sheet feeding tray 20A is accommodated in the accommodating portion 16, the center plates 76 are accommodated in a concave portion formed by a sloped plate 79 (see FIG. 2) provided at a rear portion of the casing 14 on a rear side. As a result, when the recording sheet 12 placed on the bottom plate 74 is fed by the sheet feeding section 28, the recording sheet 12 is guided to the conveying path 65 along a front surface of the sloped plate 79.

The main tray stop portions 68 (see FIGS. 3A and 3B) respectively abut against the rear right plate 77 and the rear left plate 78 of the main tray 31 of the upper sheet feeding tray 20A inserted rearward (in a inserting direction) through the opening 13. The abutment of the rear right plate 77 and the rear left plate 78 of the upper sheet feeding tray 20A against the main tray stop portion 68 prevents further rearward movement of the upper sheet feeding tray 20A. At this time, the upper sheet feeding tray 20A is in a state of being accommodated in the accommodating portion 16, in other words, in a state of being mounted in the casing 14. Moreover, at this time, the upper sheet feeding tray 20A is located at a second position. That is, the main tray stop portion 68 abuts against the main tray 31 located at the second position to prevent movement of the main tray 31 toward a downstream side relative to the second position in the inserting direction, that is, toward a rear side.

[Extension Tray 32]

Figure 4B:
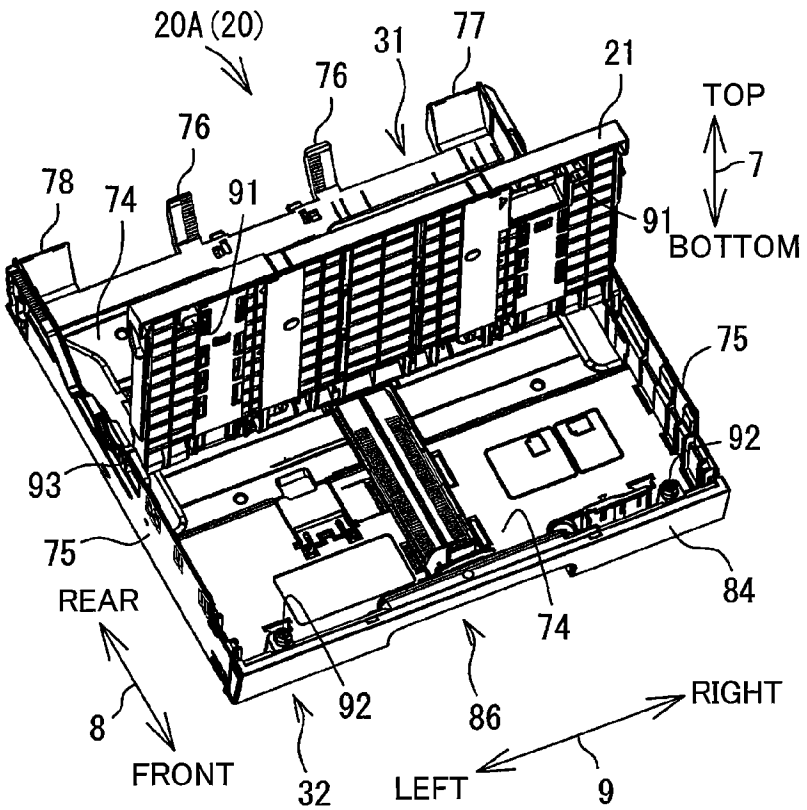
Figure 4A:
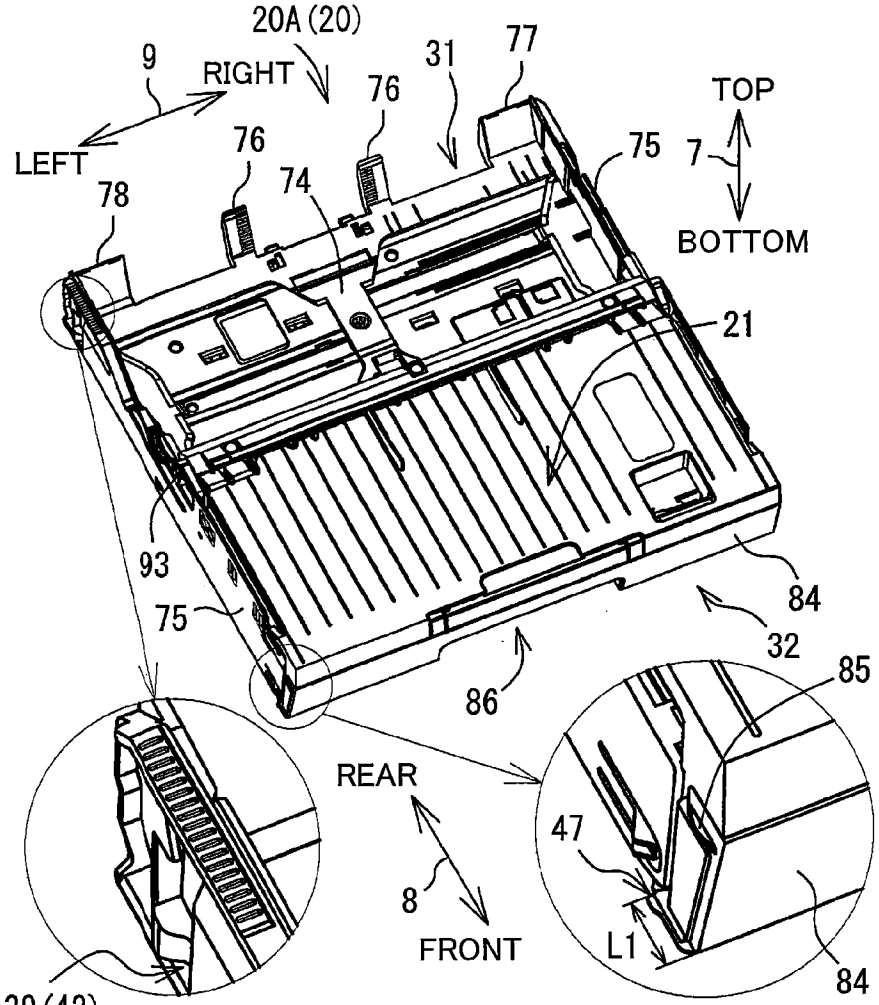
Figure 5:
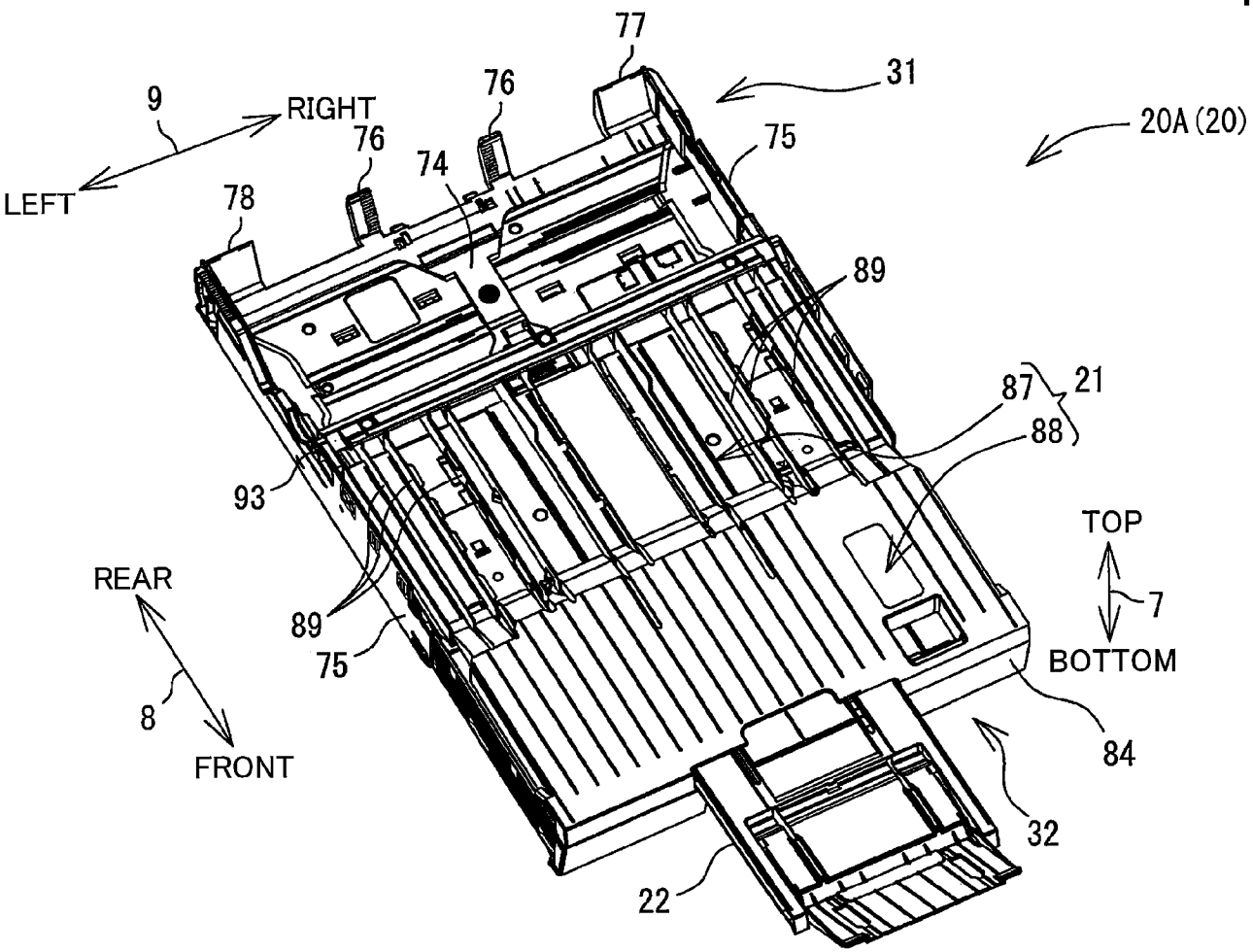
FIG. 5 is a perspective view of the sheet feeding tray in a state where an extension tray is pulled out from a main tray and the upper side of the sheet feeding tray is covered by the discharge tray.
Figure 6:
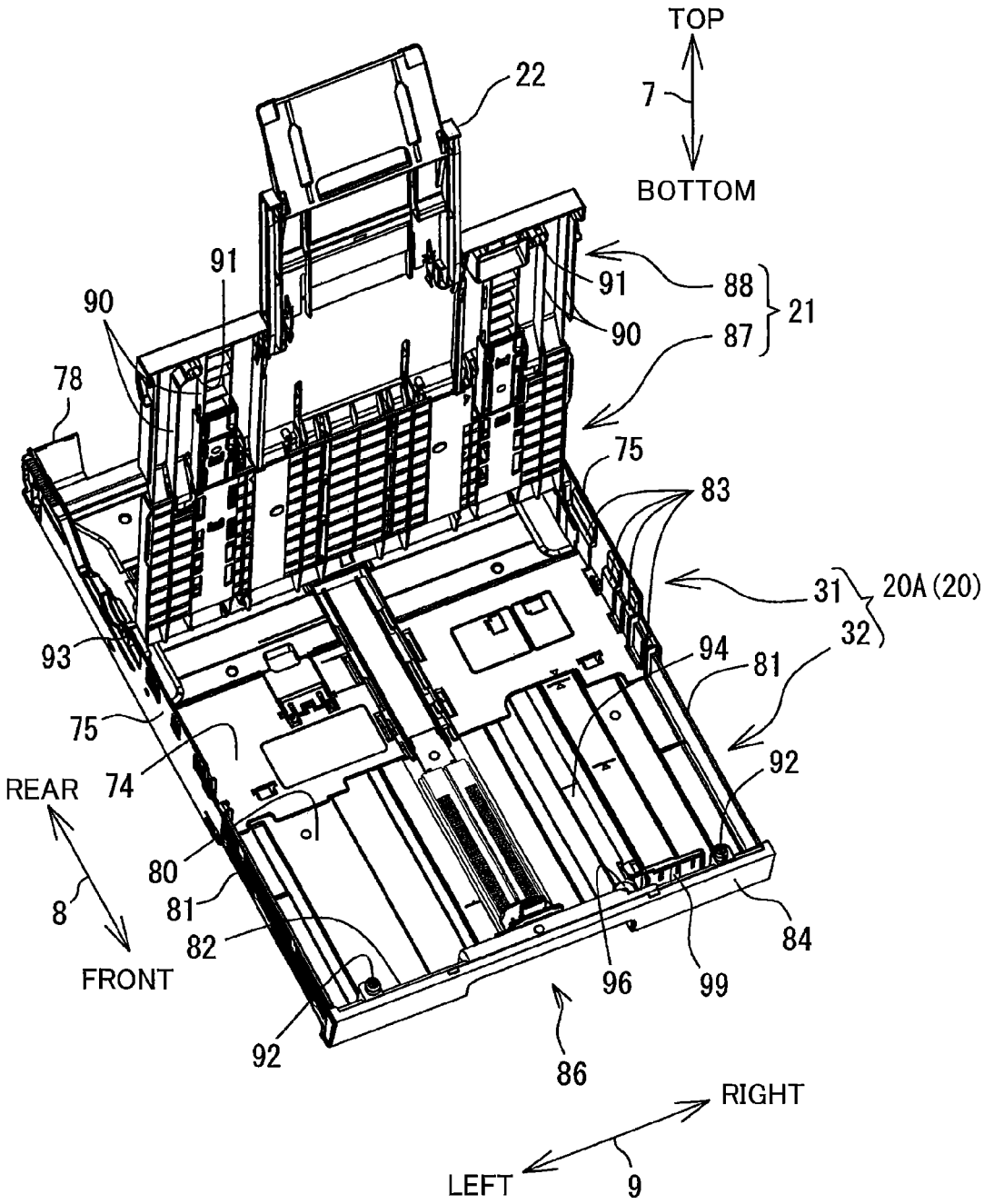
FIG. 6 is a perspective view of the sheet feeding tray in a state where the extension tray is pulled out from the main tray and the upper side of the sheet feeding tray is exposed to an outside.
Figure 7B:
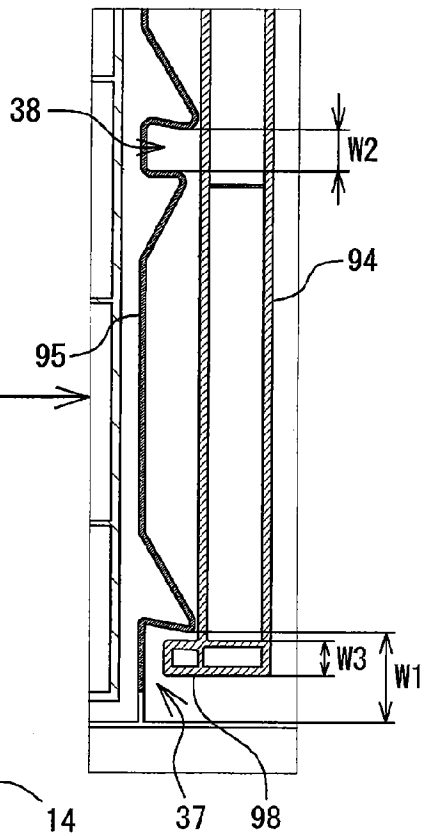
FIG. 7B is an enlarged view of a part of the engaging portion marked by a rectangle of FIG. 7A.
Figure 7A:
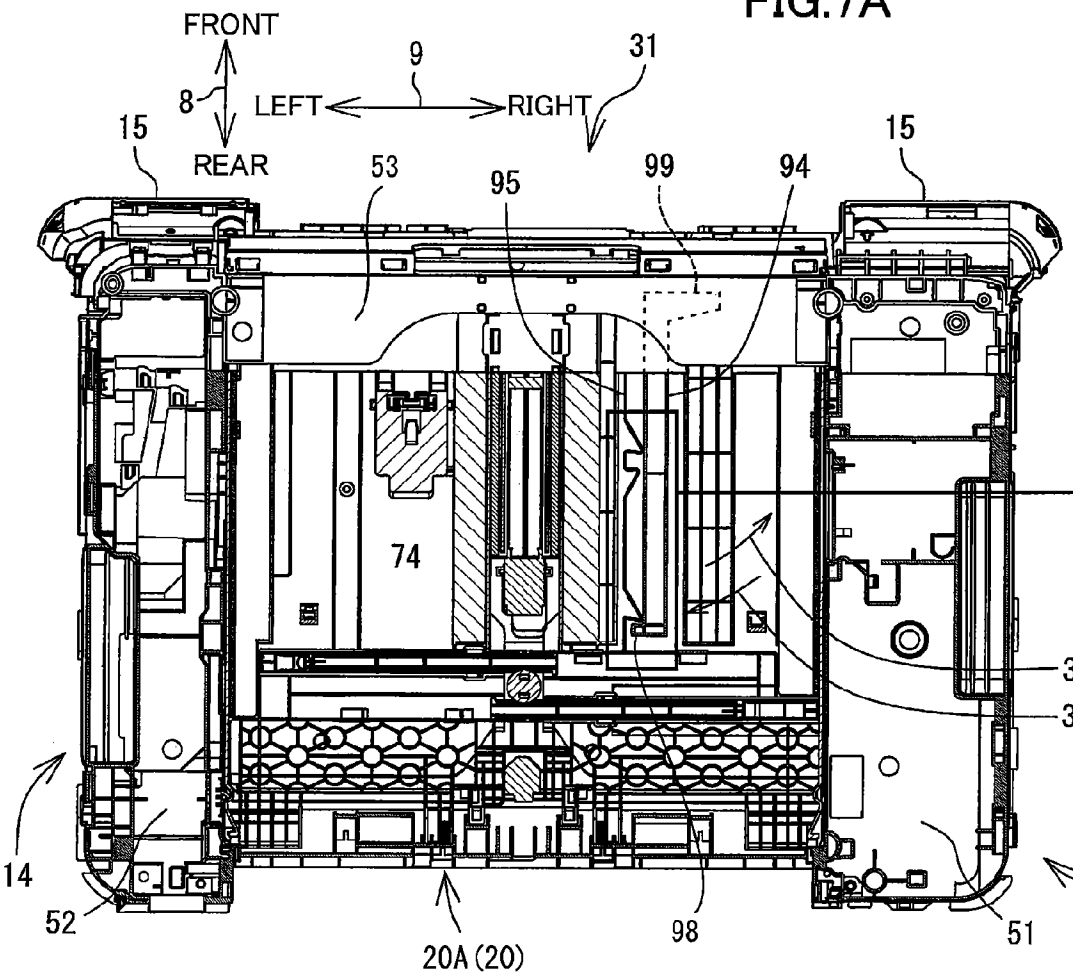
FIG. 7A is a bottom plan view illustrating the sheet feeding tray, the casing, and an engaging portion.

As illustrated in FIGS. 4A, 4B, 5, and 6, the extension tray 32 is configured to be movable relative to the main tray 31 along the inserting direction of the main tray 31, that is, in the front-rear direction 8. The extension tray 32 is pulled out from a front end of the main tray 31. As illustrated in FIGS. 4A and 4B, in a state of being inserted into the main tray 31, the extension tray 32 is located below the main tray 31 so as to be overlapped therewith. As illustrated in FIG. 6, in a state of being pulled out from the main tray 31, the extension tray 32 is located at a front side of the main tray 31.

As illustrated in FIG. 6, the extension tray 32 includes a bottom plate 80, a pair of side plates 81, and a front plate 82. The pair of side plates 81 extends vertically upward from both left and right end portions of the bottom plate 80. The front plate 82 extends vertically upward from a front end of the bottom plate 80. The side plates 81 of the extension tray 32 each are adjacent to inner sides of the side plates 75 of the main tray 31 in the left-right direction 9. Moreover, the side plates 75 of the main tray 31 each have engaging portions 83 to be engaged with upper edges of the side plates 81. The engaging portions 83 allow the side plates 81 of the extension tray 32 to be moved in the front-rear direction 8 while preventing the side plates 81 of the extension tray 32 from being moved in the left-right direction 9. With this configuration, the extension tray 32 is slidingly movable in the front-rear direction 8 relative to the main tray 31. That is, the extension tray 32 can be pulled out forward from the main tray 31 and inserted rearward thereinto.

As illustrated in FIGS. 4A and 4B, in a state where the extension tray 32 is inserted into the main tray 31, the recording sheet 12 is placed on the bottom plate 74 of the main tray 31. On the other hand, as illustrated in FIG. 6, in a state where the extension tray 32 is pulled out from the main tray 31, the recording sheet 12 is placed on the bottom plate 74 of the main tray 31 and the bottom plate 80 of the extension tray 32. That is, the extension tray 32 in the state of being pulled out from the main tray 31 supports, together with the main tray 31, the recording sheet 12.

As illustrated in FIG. 6, the tray cover 84 is mounted to the front plate 82 provided at the front side of the extension tray 32. The tray cover 84 is substantially a box-shaped member whose lengths in the upper-lower direction 7 and in the left-right direction 9 are greater than a length in the front-rear direction 8 and whose rear side is opened. The tray cover 84 is fixed to the front plate 82 so as to accommodate the front plate 82 in the opened space, in other words, so as to cover the front plate 82.

As illustrated in FIG. 4A, the tray cover 84 has projections 85. The projections 85 are each formed on right and left side surfaces of the tray cover 84 so as to protrude rightward from the right side surface and leftward from the left side surface. That is, the left and right ends of the tray cover 84 protrude outward of the extension tray 32 in the left-right direction 9. In FIG. 4A, the projection 85 protruding from the right side surface of the tray cover 84 is hidden and not shown.

The projections 85 can be resiliently deformed in the left-right direction 9. In the present embodiment, resilient deformation of the right and left side surfaces of the tray cover 84 allows resilient deformation of the projections 85 in the left-right direction 9. That is, the right and left projections 85 are resiliently deformed in an integrated manner with the right and left side surfaces of the tray cover 84.

A distance between a right end of the right projection 85 and a left end of the left projection 85 is slightly greater than a distance between a left surface 33 (see FIGS. 3A, 3B) of the right frame 51 and a right surface 34 (see FIGS. 3A, 3B) of the left frame 52 which serve as inner surfaces forming the accommodating portion 16. With this configuration, when the extension tray 32 is accommodated in the accommodating portion 16, the projections 85 are brought into pressure contact with the left and right surfaces 33 and 34. Then, the projections 85 (more in detail, the right and left side surfaces of the tray cover 84) are resiliently deformably moved inward in the left-right direction 9. As a result, in a state where the upper sheet feeding tray 20A is mounted in the casing 14, a position of the upper sheet feeding tray 20A in the left-right direction 9 can be fixed.

As illustrated in FIGS. 1, 4A, and 4B, the upper sheet feeding tray 20A is formed with a recess 86. The recess 86 is formed on an upstream side of the extension tray 32 in the inserting direction. More specifically, the recess 86 is formed in a front surface of the tray cover 84 at its center portion in the left-right direction 9 and its lower end portion. A user of the multifunction device 10 holds the recess 86 when inserting the upper sheet feeding tray 20A into the casing 14 or pulling the upper sheet feeding tray 20A from the casing 14.

[Discharge Tray 21]

As illustrated in FIGS. 4A, 4B, 5, and 6, the discharge tray 21 is disposed above the upper sheet feeding tray 20A so as to be overlapped therewith in the upper-lower direction 7. The discharge tray 21 is inserted into and removed from the casing 14 in an integrated manner with the upper sheet feeding tray 20A. As illustrated in FIGS. 5 and 6, the discharge tray 21 includes a first receiving member 87 and a second receiving member 88. The first receiving member 87 is a member having substantially a flat-plate shape. The first receiving member 87 is pivotally movably supported at the side plates 75 of the main tray 31, which will be described later in detail. The first receiving member 87 has an upper surface on which a plurality of ribs 89 (see FIG. 5) is formed. The plurality of ribs 89 is arranged juxtaposed with each other in the left-right direction 9 at intervals and extends in the front-rear direction 8.

The second receiving member 88 is a member having substantially a flat-plate shape. A front end of the second receiving member 88 is supported at the front plate 82 of the extension tray 32. The second receiving member 88 has a lower surface on which a plurality of ribs 90 (see FIG. 6) is formed. The plurality of ribs 90 is arranged juxtaposed with each other in the left-right direction 9 at intervals and extends in the front-rear direction 8. The ribs 90 are each positioned between the ribs 89 so as to be able to abut against the ribs 89. Thus, each rib 90 can be slidingly moved in the front-rear direction 8 between the two neighboring ribs 89. Accordingly, the second receiving member 88 can be slidingly moved relative to the first receiving member 87 in the front-rear direction 8. In the present embodiment, the second receiving member 88 can be pulled out frontward from and inserted rearward into a front end portion of the first receiving member 87.

Concave portions 91 are formed on a lower surface of the second receiving member 88. More specifically, the concave portions 91 are formed at both left and right end portions of the front end portion of the second receiving member 88. On the other hand, convex portions 92 are formed on an upper surface of the front plate 82 of the extension tray 32. More specifically, the convex portions 92 are formed at positions opposite to the concave portions 91, respectively. Each convex portion 92 is insertable into the corresponding concave portion 91. The second receiving member 88 is supported by the extension tray 32 in a state where the convex portions 92 are inserted into the corresponding concave portions 91, whereby the extension tray 32 positions the discharge tray 21. As a result, as illustrated in FIGS. 4A and 5, when the extension tray 32 is moved relative to the main tray 31, the second receiving member 88 is correspondingly moved relative to the first receiving member 87. In both FIG. 4A and FIG. 5, the discharge tray 21 is disposed above the extension tray 32 of the upper sheet feeding tray 20A.

As described above, a rear end portion of the first receiving member 87 is pivotally supported by the side plates 75 of the main tray 31. More specifically, a pivot shaft 93 protrudes outward in the left-right direction 9 from the rear end portion of the first receiving member 87 and is inserted into an opening formed in each side plate 75. With this configuration, the discharge tray 21 can be pivotally moved between a position illustrated in FIG. 4A and a position illustrated in FIG. 4B in a state where the extension tray 32 is inserted into the main tray 31. Moreover, the discharge tray 21 can be pivotally moved between a position illustrated in FIG. 5 and a position illustrated in FIG. 6 in a state where the extension tray 32 is pulled out from the main tray 31.

[Engaging Portion 94 and Engaged Portion 95]

As illustrated in FIG. 6, an engaging portion 94 is formed on an upper surface of the bottom plate 80 of the extension tray 32. As illustrated in FIG. 7A, the engaging portion 94 has an elongated configuration and is formed in generally a bar-shape. FIG. 7A illustrates the upper sheet feeding tray 20A and the casing 14 as viewed from below, in which the extension tray 32 is omitted, excluding the engaging portion 94 thereof, to facilitate visualization of the engaging portion 94.

As illustrated in FIG. 6, the engaging portion 94 is attached to the bottom plate 80 in such a manner that a longitudinal direction (elongating direction) thereof substantially coincides with the front-rear direction 8. The engaging portion 94 has a front end portion at which an opening or a concave portion is formed. A shaft portion 96 formed at a right front end portion of the bottom plate 80 is inserted into the opening or the concave portion of the engaging portion 94, whereby the engaging portion 94 is pivotally supported to the bottom plate 80. With this configuration, as illustrated in FIGS. 6 and 7A, the engagement portion 94 can be pivotally moved about an axis of the shaft portion 96 formed at the front end portion of the bottom plate 80 in directions denoted by arrows 35 and 36. The pivotal movement of the engaging portion 94 in the directions denoted by arrows 35 and 36 is achieved by the user of the multifunction device 10 holding an operation portion 99 formed at the front end portion of the engaging portion 94.

As illustrated in FIGS. 7A and 7B, the engaging portion 94 has a protrusion 98. The protrusion 98 protrudes leftward from a rear end portion of the engaging portion 94. The protrusion 98 is engageable with an engaged portion 95 (described later).

As illustrated in FIGS. 7A and 7B, the engaged portion 95 is formed on a lower surface of the bottom plate 74 of the main tray 31. The engaged portion 95 is a rib extending substantially in the front-rear direction 8 and has a plurality of (two in the present embodiment) engagement receiving portions 37 and 38 arranged at intervals in the front-rear direction 8. The engagement receiving portions 37 and 38 are each a recessed portion recessed leftward and capable of being engaged with the protrusion 98 of the engaging portion 94. That is, the engagement receiving portions 37 and 38 are each formed in a rib extending in the front-rear direction 8, and the rib is bent at two locations to form the recessed portions.

The engaging portion 94 is pivotally moved in the directions of the arrows 35 and 36 to thereby allow engagement with and disengagement from the engaged portion 95. For example, when the protrusion 98 of the engaging portion 94 is engaged with the engagement receiving portion 37 in a state where the extension tray 32 is inserted into the main tray 31 (see FIG. 4A), the extension tray 32 is in a state of being locked to the main tray 31, preventing the extension tray 32 from being pulled out from the main tray 31.

In this state, when the user of the multifunction device 10 holds the operation portion 99 to pivotally move the engaging portion 94 in the direction of the arrow 35, the engagement between the protrusion 98 and the engagement receiving portion 37 is released. As a result, the locked state between the extension tray 32 and the main tray 31 is released, allowing the extension tray 32 to be pulled out from the main tray 31. In this state, the user of the multifunction device 10 pulls the extension tray 32 from the main tray 31 (see FIG. 5). In the state illustrated in FIG. 5, the protrusion 98 faces the engagement receiving portion 38. In this state, when the user of the multifunction device 10 holds the operation portion 99 to pivotally move the engaging portion 94 in the direction of the arrow 36, the protrusion 98 and the engagement receiving portion 38 are engaged with each other. As a result, the extension tray 32 is locked to the main tray 31 in a state of being pulled out from the main tray 31.

As illustrate in FIG. 7B, the engagement receiving portion 37 has a width W1 in the front-rear direction 8, the engagement receiving portion 38 has a width W2 in the front-rear direction 8, and the protrusion 98 of the engaging portion 94 has a width W3 in the front-rear direction 8. The widths W1 and W2 are each made greater than the width W3. With this configuration, in a state where the protrusion 98 and the engagement receiving portion 37 or 38 are engaged with each other, the engaging portion 94 can be moved relative to the engaged portion 95 in the front-rear direction 8. That is, in a state where the extension tray 32 is inserted into the main tray 31, the extension tray 32 can be moved relative to the main tray 31 in the front-rear direction 8 by a distance corresponding to a difference between the width W1 and the width W3. However, further movement of the extension tray 32 is prevented. Similarly, in a state where the extension tray 32 is pulled out from the main tray 31, the extension tray 32 can be moved relative to the main tray 31 in the front-rear direction 8 by a distance corresponding to a difference between the width W2 and the width W3. However, further movement of the extension tray 32 is prevented.

Although the above engagement and disengagement between the engaging portion 94 and the engaged portion 95 is achieved by the pivotal movement of the engaging portion 94 in the present embodiment, the engagement and disengagement may be achieved by any movement other than the pivotal movement, for example, movement of the engaging portion 94 in the left-right direction 9. Moreover, although the engagement and disengagement between the engaging portion 94 and the engaged portion 95 is achieved by the movement of the engaging portion 94 in the present embodiment, the engagement and disengagement may be achieved by movement of the engaged portion 95. That is, in this case, contrary to the above, the engaging portion 94 formed on the extension tray 32 may be formed in a rib extending in the front-rear direction 8, and the engaged portion 95 formed on the main tray 31 may be formed in a bar-shaped member. In this case, contrary to the above, the engaged portion 95 is configured to be movable relative to the engaging portion 94 in the front-rear direction 8 in a state where the engaged portion 95 and the engaging portion 94 are engaged with each other.

[Drawing Portion 39]

As illustrated in FIGS. 3A, and 4A, the multifunction device 10 has a drawing portion 39 that draws the main tray 31 into the above-described second position from a predetermined position when the main tray 31 reaches the predetermined position while the upper sheet feeding tray 20A is inserted into the accommodating portion 16. In the present embodiment, a pair of drawing portions 39, i.e., two drawing portions 39 are provided in the left-right direction 9; however, in the following description, only the drawing portion 39 on the left side will be described, and description of the drawing portion 39 on the right side will be omitted.

The above-described predetermined position, which refers to a first position of the present invention, is a position of the upper sheet feeding tray 20A at a moment when an abutted portion 42 (see FIG. 4A, described later) provided in the upper sheet feeding tray 20A and a second guide surface 44 (see FIGS. 8A, 8B, described later) disposed in the accommodating portion 16 shift from a non-abutting state to an abutting state while the upper sheet feeding tray 20A is being inserted into the accommodating portion 16.

The second position is, as described above, a position of the upper sheet feeding tray 20A when the rear right plate 77 and the rear left plate 78 of the upper sheet feeding tray 20A abut against the main tray stop portions 68, respectively. The upper sheet feeding tray 20A at the second position is located on the downstream side, in the inserting direction, of the upper sheet feeding tray 20A at the predetermined position, i.e., rearward of the predetermined position. Moreover, when the upper sheet feeding tray 20A is at the second position, the recording sheet 12 placed on the bottom plate 74 of the upper sheet feeding tray 20A can be fed to the conveying path 65 by the sheet feeding section 28.

The drawing portion 39 includes an abutting portion 40 (FIG. 3A), a moving portion 41 (FIG. 3A), and the abutted portion 42 (FIG. 4A). The abutting portion 40 protrudes toward the accommodating portion 16 (i.e. inward in the left-right direction 9) from the moving portion 41. The moving portion 41 is resiliently movably supported to the right surface 34 of the left frame 52 serving as the inner wall defining the accommodating portion 16.

The moving portion 41 illustrated in FIG. 3A has an upper end portion attached to the right surface 34 of the left frame 52, however, the remaining portion of the moving portion 41 other than the upper end portion is spaced apart from the right surface 34. Moreover, the moving portion 41 has a lower end portion at which the abutting portion 40 is formed. With this configuration, the moving portion 41 can be bent by resilient deformation in the left-right direction 9 about the upper end portion. The bending of the moving portion 41 in the left-right direction 9 by resilient deformation causes the abutting portion 40 formed at the moving portion 41 to move in the left-right direction 9.

Figure 8B:
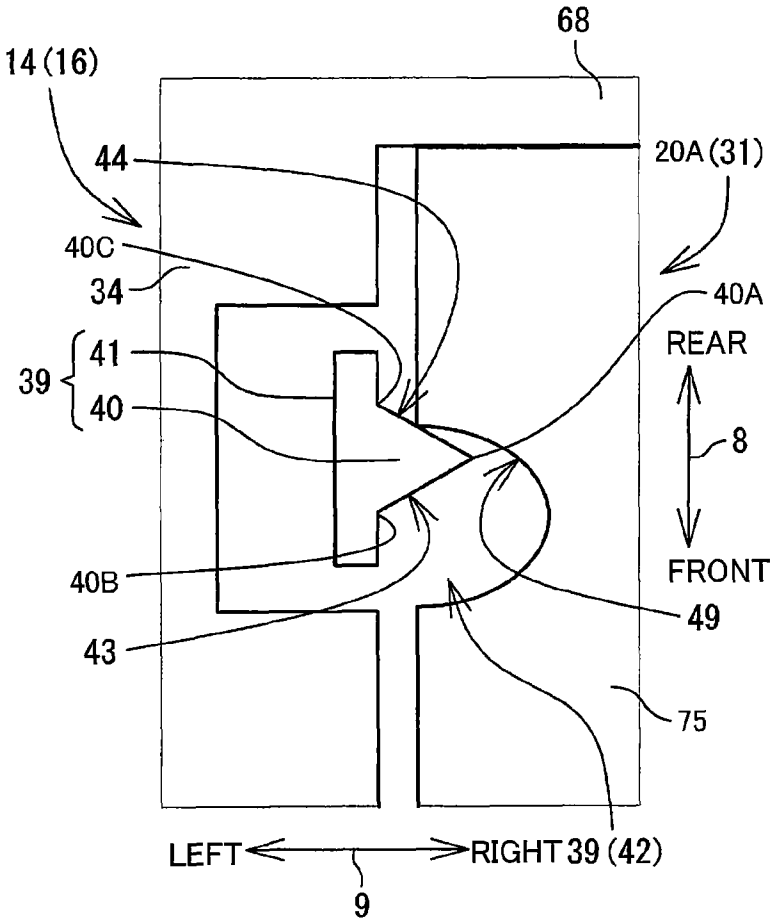
FIGS. 8A and 8B are schematic horizontal cross-sectional views illustrating a drawing portion.
Figure 8A:
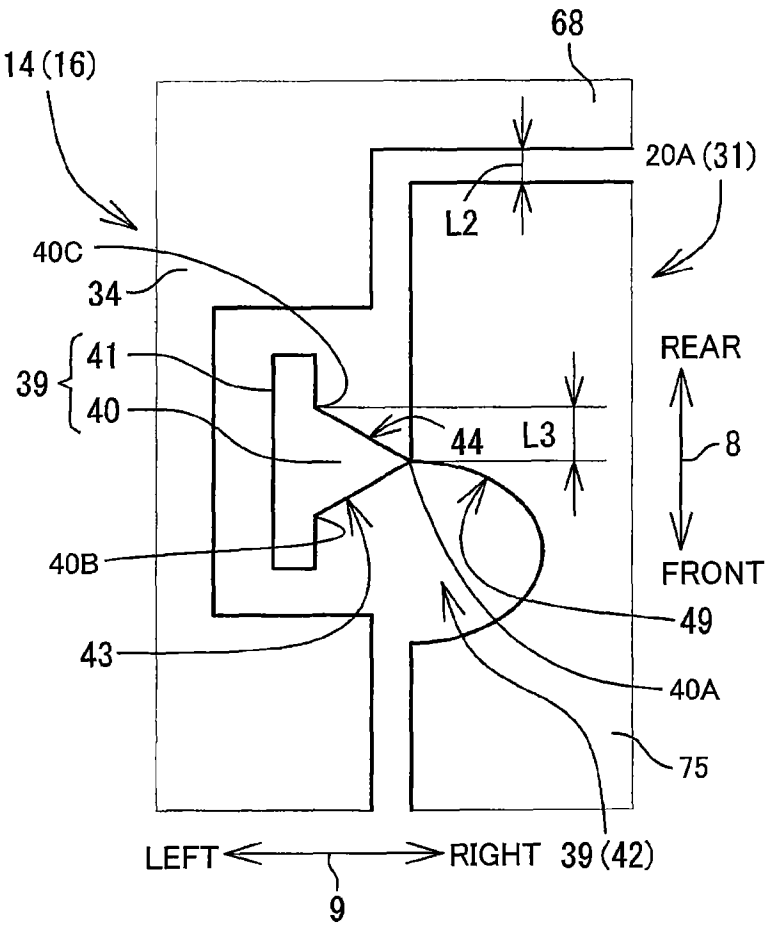

As illustrated in FIGS. 8A and 8B, the abutting portion 40 has a first guide surface 43 and the second guide surface 44. The first guide surface 43 is a surface extending diagonally rearward and rightward from a front end 40B of the abutting portion 40. The first guide surface 43 is inclined such that a rear side thereof protrudes in the left-right direction 9 (i.e. rightward) further than a front side thereof. In other words, the first guide surface 43 is inclined such that a rear end thereof (peak 40A) is farther from the right surface 34 of the left frame 52 than the front end 40B from the right surface 34 of the left frame 52 in the left-right direction 9. The second guide surface 44 is a surface extending diagonally rearward and leftward from the rear end of the first guide surface 43 (peak 40A). The second guide surface 44 is inclined such that a front side thereof protrudes in the left-right direction 9 (i.e. rightward) further than a rear side thereof. In other words, the second guide surface 44 is inclined such that a front end thereof (peak 40A) is farther from the right surface 34 of the left frame 52 than a rear end 40C thereof from the right surface 34 of the left frame 52 in the left-right direction 9.

A distance between the abutting portion 40 of the left drawing portion 39 and the abutting portion 40 of the right drawing portion 39 is smaller than a length of the upper sheet feeding tray 20A in the left-right direction 9. Accordingly, when the upper sheet feeding tray 20A is inserted into or pulled out from the accommodating portion 16, each abutting portion 40 abuts against the upper sheet feeding tray 20A. Then, the abutting portion 40 is inserted by the upper sheet feeding tray 20A to be spaced apart from the upper sheet feeding tray 20A in the left-right direction 9, causing the corresponding moving portion 41 to be bent.

As illustrated in FIG. 4A, the abutted portion 42 is a recess formed in a rear end portion of the side plate 75 of the upper sheet feeding tray 20A. The abutted portion 42 is provided at a position abuttable against the abutting portion 40 when the upper sheet feeding tray 20A is inserted into or pulled out from the accommodating portion 16. As illustrated in FIGS. 8A and 8B, the abutted portion 42 is defined by a surface 49.

[Extension Tray Stop Portion 45]

As illustrated in FIGS. 3A and 3B, a pair of extension tray stop portions 45 is each provided at a right end portion of the left frame 52 and a left end portion of the right frame 51. That is, the extension tray stop portions 45 are each provided on the left surface 33 of the right frame 51 of the casing 14 and the right surface 34 of the left frame 52 of the casing 14. In this description, the extension tray stop portion 45 provided at the left frame 52 illustrated in FIG. 3A will be described. The extension tray stop portion 45 has a portion disposed above the front bottom frame 53. The extension tray stop portion 45 is a wall having a front surface 46 extending substantially in the upper-lower direction 7 and the left-right direction 9. The surface 46 intersects the inserting direction of the extension tray 32 which coincides with the front-rear direction 8.

On the other hand, as illustrated in FIG. 4A, a pair of extension tray abutment portions 47 is provided at a front end portion of the extension tray 32. That is, the extension tray abutment portions 47 are provided at both end portions of the extension tray 32 in the left-right direction 9. Each of the pair of extension tray abutment portions 47 is a rear surface of a protruding portion protruding outward in the left-right direction 9 from an outside surface of each of the pair of side plates 81 (see FIG. 6) of the extension tray 32 in the left-right direction 9. Each extension tray abutment portion 47 abuts against the surface 46 (see FIG. 3A) of the extension tray stop portion 45 when the upper sheet feeding tray 20A is inserted into the accommodating portion 16. The abutment between the extension tray abutment portion 47 and the surface 46 prevents further movement of the extension tray 32 in the inserting direction, that is, prevents further rearward movement of the extension tray 32. Although the extension tray abutment portion 47 is provided at the side plate 81 of the extension tray 32 in the present embodiment, the extension tray abutment portion 47 may be provided at the tray cover 84 fixed to the extension tray 32.

As illustrated in FIG. 3A, the extension tray stop portion 45 is disposed inward of the outer surface of the outer cover 15 covering the casing 14 and mounted to the casing 14 of the multifunction device 10.

A distance in the front-rear direction 8 between the surface 46 of the extension tray stop portion 45 and outer surfaces of the outer covers 15 covering the casing 14 at positions in proximity to the extension tray 32 (next to the extension tray 32 in the left-right direction 9), among the plurality of outer covers 15 covering the casing 14, is the same as a distance L1 illustrated in FIG. 4A. The distance L1 is a distance in the front-rear direction 8 between the extension tray abutment portion 47 and the front end of the extension tray 32 (in the present embodiment, the front surface of the tray cover 84). This is a case where the outer covers 15 are mounted to the casing 14. On the other hand, when the outer covers 15 are not mounted to the casing 14, a distance to be compared with the distance L1 is a distance in the front-rear direction 8 between the surface 46 of the extension tray stop portion 45 and an outer surface of the casing 14.

With the configuration in which the distance between the surface 46 of the extension tray stop portion 45 and the outer surfaces of the outer covers 15 is the same as the distance L1, in a state where the surface 46 of the extension tray stop portion 45 abuts against the extension tray abutment portion 47 as illustrated in FIG. 1, the outer covers 15 located next to the extension tray 32 in the left-right direction 9 and the tray cover 84 are flush with each other. In other words, in a state where the extension tray 32 is stopped by the extension tray stop portion 45, the front surface of the tray cover 84 of the extension tray 32 and the front surfaces of the outer covers 15 neighboring the extension tray 32 in the left-right direction 9 are flush with each other.

[Insertion of Sheet Feeding Tray 20]

The following describes an operation to be performed when the upper sheet feeding tray 20A is inserted into the casing 14 through the opening 13 and accommodated in the accommodating portion 16. The upper sheet feeding tray 20A is inserted into the casing 14 in a state where the extension tray 32 is inserted into the main tray 31 and locked thereto.

The upper sheet feeding tray 20A is moved toward the rear side of the accommodating portion 16 from the opening 13, that is, moved rearward. When the upper sheet feeding tray 20A is moved toward the rear side of the accommodating portion 16, the rear end portion of the main tray 31 abuts against the abutting portions 40. As a result, the abutting portions 40 are spaced apart from the main tray 31 in the left-right direction 9, causing the moving portions 41 are bent in the left-right direction 9.

In this state, the upper sheet feeding tray 20A is further moved rearward, the pair of side plates 75 of the main tray 31 are slidingly moved rearward relative to the abutting portions 40 while being brought into pressure contact with the abutting portions 40 (more in detail, the peaks 40A of the abutting portions 40 protruding toward the pair of side plates 75 and defined by the first guide surfaces 43 and the second guide surfaces 44). As a result, the front end of the second guide surface 44 of each abutting portion 40, that is, the peak 40A of each abutting portion 40 shifts from a non-abutting state where the peak 40A does not abut against the corresponding abutted portion 42 to an abutting state where the peak 40A abuts against the corresponding abutted portion 42 (see FIG. 8A). The position of the main tray 31 at this state is the above-mentioned first position of the present invention.

When the second guide surface 44 and the abutted portion 42 abut against each other, the abutting portion 40 enters into the abutted portion 42 by the resilient force, by which the moving portion 41 is returned to its original state, generated by the bending of the moving portion 41, that is, by the force by which the abutting portion 40 is moved toward the main tray 31. With this movement, the surface 49 constituting the abutted portion 42 is slidingly moved along the second guide surface 44 of the abutting portion 40. As a result, the main tray 31 is moved rearward, that is, toward the second position located rearward of the first position. That is, the main tray 31 is drawn into the second position.

As illustrated in FIG. 8A, a travel distance L2 of the main tray 31 in the front-rear direction 8 from the first position to the second position, that is, to a position where the main tray 31 abuts against the main tray stop portions 68, is smaller than a length L3 of the second guide surface 44 in the front-rear direction 8 (i.e. distance between the front end of the second guide surface 44 (i.e. peak 40A) and the rear end 40C of the second guide surface 44 in the front-rear direction 8). Accordingly, as illustrated in FIG. 8B, the main tray 31 reaches the second position before the abutting portion 40 fully enters into the corresponding abutted portion 42 to stop the sliding movement of the abutting portion 40. As a result, the main tray 31 can be reliably located at the second position.

Moreover, in a state where the main tray 31 is located rearward of the first position in the front-rear direction 8 and is in the course of being drawn into the second position or is located at the second position, each extension tray abutment portion 47 (see FIG. 4A) provided in the extension tray 32 abuts against the surface 46 (see FIG. 3A) of the corresponding extension tray stop portion 45 provided at the casing 14. This prevents rearward movement of the extension tray 32, thereby positioning the extension tray 32 in the front-rear direction 8.

Assuming that the extension tray abutment portion 47 and the surface 46 abut against each other in a state where the main tray 31 is located frontward of the first position in the front-rear direction 8, the main tray 31 is not drawn into the second position, failing to locate the main tray 31 at the second position. However, as described above, the extension tray abutment portion 47 and the surface 46 abut against each other in the state where the main tray 31 is located rearward of the first position in the front-rear direction 8, thereby preventing occurrence of such a problem.

The travel distance of the extension tray 32 relative to the main tray 31 in a state where the main tray 31 has reached the second position is preferably small. For example, in order to reduce the relative travel distance, the main tray 31, the extension tray 32, and the accommodating portion 16 may be configured such that each extension tray abutment portion 47 and the corresponding surface 46 abut against each other in a state where the main tray 31 is located between the first and second positions in the front-rear direction 8.

The travel distance L2 (see FIG. 8A) which is a travel distance of the main tray 31 between the first and second positions in the front-rear direction 8 is smaller than a distance that the engaging portion 94 and the engaged portion 95 (see FIG. 7B) can move relative to each other in a state where they are engaged with each other. The distance that the engaging portion 94 and the engaged portion 95 can move relative to each other corresponds to, as illustrated in FIG. 7B, a distance between the width W1 and the width W3 when the engagement receiving portion 37 of the engaged portion 95 and the protrusion 98 of the engaging portion 94 are engaged with each other.

If the extension tray 32 is moved forward at a maximum extent relative to the main tray 31, there is a possibility that the extension tray stop portion 45 fails to abut against the corresponding extension tray abutment portion 47 in the course of the drawing operation by the drawing portion 39. However, in the present embodiment, the force required for the extension tray 32 to be moved relative to the main tray 31 is smaller than the force required for the resilient deformation of the moving portions 41 of the drawing portions 39. Thus, even if the extension tray 32 is moved forward at a maximum extent relative to the main tray 31, the extension tray 32 can be moved rearward from the position where the extension tray 32 is moved forward at a maximum extent relative to the main tray 31 while the upper sheet feeding tray 20A is being inserted into the accommodating portion 16. As a result, in the course of the drawing operation by the drawing portions 39, the extension tray 32 is subjected to positioning by the extension tray stop portions 45.

Effects of Embodiment

According to the present embodiment, in a state where each sheet feeding tray 20 (upper sheet feeding tray 20A and lower sheet feeding tray 20B) is mounted in the casing 14, the front side position of the sheet feeding tray 20 is determined by a position of the extension tray 32 provided on the front side of the main tray 31. The position of the extension tray 32 can be fixed by the extension tray stop portion 45. This allows a desired outer appearance of the multifunction device 10 to be obtained. Moreover, according to the present embodiment, the main tray 31 is drawn into the second position by the drawing portions 39, thereby allowing the sheet feeding tray 20 to be reliably mounted at a position at which the supported recording sheet 12 cab be fed therefrom.

Moreover, according to the present embodiment, the main tray 31 is positioned not by a biasing force of a coil spring but by the drawing portions 39. Thus, there does not a problem that the main tray 31 cannot be pulled out until the coil spring is fully stretched even if the extrusion tray 32 is pulled when the sheet feeding tray 20 is pulled out from the casing 14. As a result, the sheet feeding tray 20 can smoothly be pulled out from the casing 14. That is, operability of the sheet feeding tray 20 can be kept favorable. Thus, according to the present embodiment, the outer appearance formed by the sheet feeding tray 20 and the casing 14 can be made into a desired condition, and the sheet feeding tray 20 can smoothly be pulled out from the casing 14.

Moreover, according to the present embodiment, in a state where the extension tray 32 is inserted into the main tray 31 and locked to the main tray 31, the main tray 31 can be moved relative to the extension tray 32 by a distance corresponding to a difference between the width W1 and the width W3. Thus, the drawing portions 39 can draw the main tray 31 into the accommodating portion 16 from the first position to the second position.

In other words, in the course of mounting the sheet feeding tray 20 in the accommodating portion 16, the extension tray 32 may be inserted into the main tray 31 at a maximum extent so that the rear surface of the protrusion 98 is in abutment with a rear wall of the engagement receiving portion 37. In this state, when the extension tray abutment portions 47 is brought into abutment with the surfaces 46 of the corresponding extension tray stop portions 45, the main tray 31 is located at a position between the first position and the second position in the front-rear direction 8. At this time, the drawing portions 39 are drawing the main tray 31 into the second position to move the main tray 31 rearward, while the surfaces 46 of the extension tray stop portions 45 restrict further rearward movement of the extension tray 32. Because the main tray 31 is movable relative to the extension tray 32 by the distance corresponding to the difference between the width W1 and the width W3 which is set to be greater than the travel distance L2 of the main tray 31, the drawing portions 39 can reliably draw the main tray 31 into the second position even if the extension tray abutment portions 47 has abutted against the surfaces 46 of the corresponding extension tray stop portions 45 to restrict the extension tray 32 from being moved rearward.

Moreover, according to the present embodiment, the abutting portions 40 abut against the sheet feeding tray 20 and are moved by the moving portions 41 when the sheet feeding tray 20 is inserted into the casing 14. In this state, when an upstream edge of the second guide surface 44 in the inserting direction (i.e. peak 40A of the abutting portion 40) reaches a position confronting the corresponding abutted portion 42 in the inserting direction, the abutment between the sheet feeding tray 20 (the pair of side plates 75) and the abutting portions 40 is released, and the abutting portions 40 abuts against the abutted portions 42, respectively. In this state, each abutted portion 42 is moved in the inserting direction by the travel distance L2. That is, the main tray 31 is drawn into the accommodating portion 16 by the travel distance L2. That is, the present embodiment is a preferred example of the application for realizing the function of the drawing portion 39.

Moreover, according to the present embodiment, the recess 86 is formed in the extension tray 32. The extension tray 32 is provided on the front side of the sheet feeding tray 20. Thus, operations of inserting the sheet feeding tray 20 into the casing 14 and removing the sheet feeding tray 20 from the casing 14 can be easily performed.

Moreover, according to the present embodiment, the discharge tray 21 can be positioned relative to the sheet feeding tray 20 accurately by the convex portions 92.

Moreover, according to the present embodiment, the outer surface of the tray cover 84 of the extension tray 32 and the outer surfaces of the outer covers 15 are flush with each other, thereby making the outer appearance of the multifunction device 10 look good.

Moreover, according to the present embodiment, the extension tray stop portions 45 are not exposed to an outside of the multifunction device 10, thereby making the outer appearance of the multifunction device 10 look good.

Moreover, according to the present embodiment, the extension tray stop portions 45 each have the surface 46 and can thereby easily achieve the positioning of the extension tray 32.

Moreover, according to the present embodiment, the extension tray 32 has the extension tray abutment portions 47 and can thereby easily embody a configuration for achieving the function of the extension tray stop portions 45.

Moreover, according to the present embodiment, the distance in the front-rear direction 8 between the surface 46 of each extension tray stop portion 45 and the outer surface of the outer cover 15 coincides with the distance L1. Thus, according to the present embodiment, the outer surface of the extension tray 32 and the outer surface of the casing 14 (the outer surface of the outer cover 15 covering the casing 14 in the present embodiment) can be made flush with each other.

Moreover, according to the present embodiment, the projections 85 are brought into pressure contact with the left surface 33 of the right frame 51 and the right surface 34 of the left frame 52, respectively, so that, in a state where the sheet feeding tray 20 is mounted in the casing 14, the sheet feeding tray 20 can be positioned in the left-right direction 9.

Moreover, the extension tray stop portions 45 are each provided on the left-right side of the extension tray 32, making an installation location of the extension tray stop portions 45 less likely to be restricted.

First Modification

A multifunction device 10 according to a first modification of the present invention will be described while referring to FIGS. 9 through 10B. In the following description, only parts differing from those of the above-described embodiment will be described.

Figure 9:
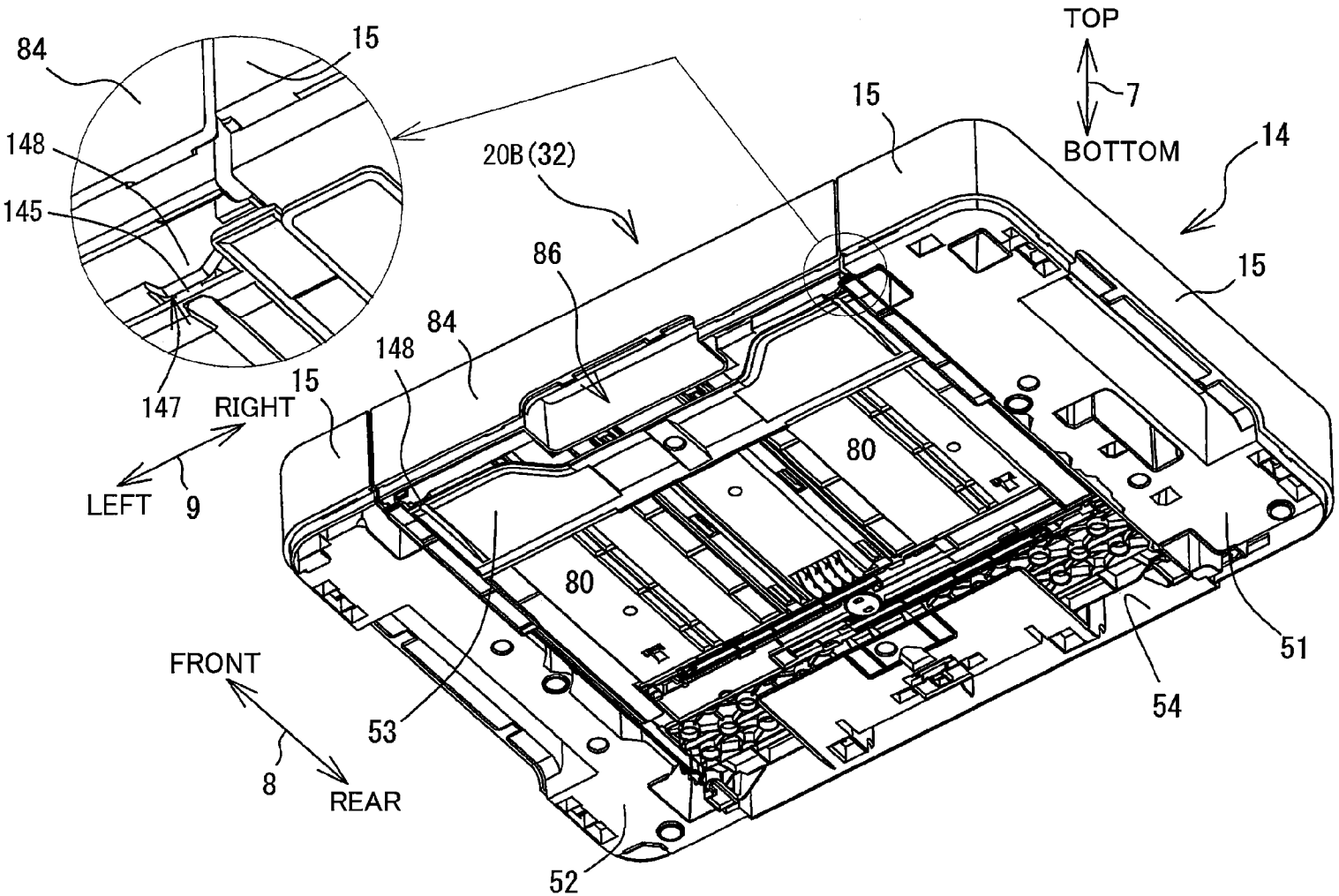
FIG. 9 is a perspective view illustrating a sheet feeding tray, and right, left, front bottom and rear bottom frames of a casing of a multifunction device according to a first modification of the present invention.
Figure 10B:
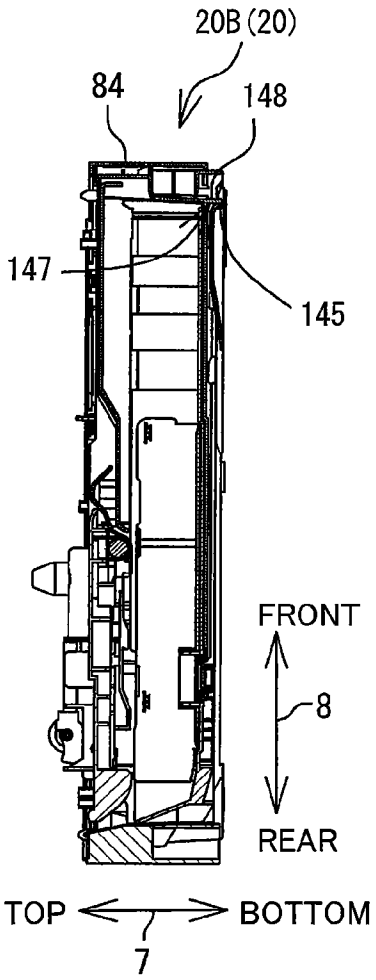
FIG. 10B is a cross-sectional view taken along a B-B line of FIG. 10A.
Figure 10A:
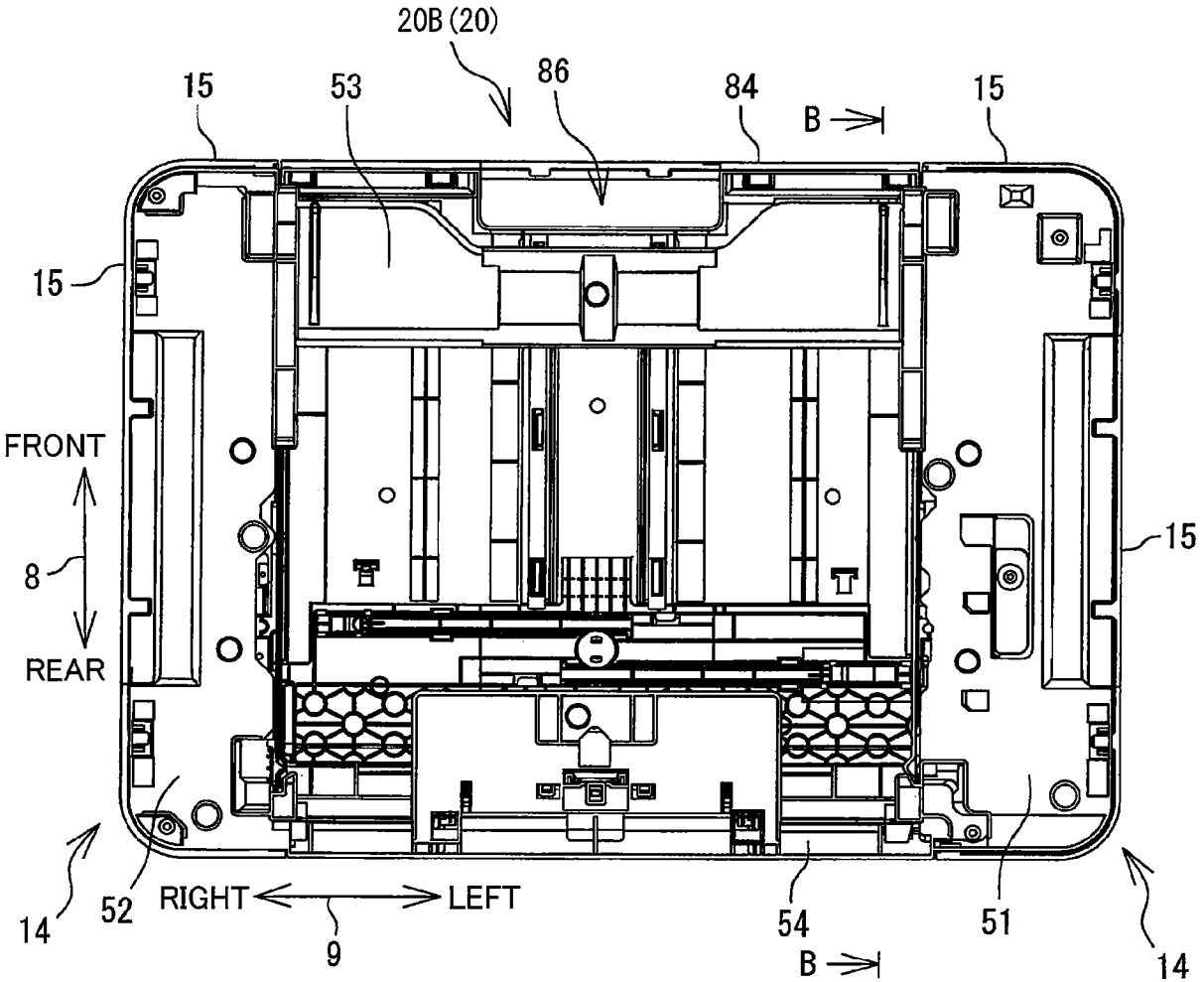
FIG. 10A is a bottom plan view illustrating a state where the sheet feeding tray is mounted in the casing of the multifunction device according to the first modification of the present invention.

Note that FIGS. 9, 10A, and 10B each illustrate only the lower sheet feeding tray 20B and a portion of the casing 14 around the accommodating portion 16 in which the lower sheet feeding tray 20B is mounted.

In the above-described embodiment, the extension tray abutment portions 47 are each provided so as to protrude outward in the left-right direction 9 from each of the pair of side plates 81 of the extension tray 32. However, an installation location of the extension tray abutment portions 47 is not limited to the side plate 81 of the extension tray 32. For example, in the first modification, as illustrated in FIGS. 9, 10A, and 10B, the lower sheet feeding tray 20B has a pair of extension tray abutment portions 147 provided at a front end portion of a lower surface of the bottom plate 80 of the extension tray 32. More specifically, the bottom plate 80 has a pair of convex portions 148 protruding downward from the lower surface thereof, and a rear surface of each of the pair of convex portions 148 serves as the extension tray abutment portion 147. In this case, a pair of extension tray stop portions 145 is each provided at a position abutting against the rear surface. That is, the pair of extension tray stop portions 145 is each provided on an upper surface of the front bottom frame 53 of the casing 14. In this configuration, a portion of the lower surface of the bottom plate 80 located rearward of the extension tray abutment portions 147 is recessed so as not to abut against the extension tray stop portions 145.

According to the first modification, the extension tray abutment portions 147 are less likely to be exposed to an outside in a state where the lower sheet feeding tray 20B supports the recording sheet 12, which does not impair the outer appearance. That is, according to the first modification, the extension tray abutment portions 147 protrude from the lower surface of the bottom plate 80 of the extension tray 32, the extension tray abutment portions 147 are not visible from outside in a state where the multifunction device 10 is installed, thereby making the outer appearance of the multifunction device 10 look good.

Second Modification

The main tray 31 and the extension tray 32 may be connected to each other by a resilient member such as a spring. A resilient force of the resilient member is smaller than the force required for the drawing portions 39 to draw the main tray 31 into the accommodating portion 16 from the first position to the second location.

According to the second modification, the main tray 31 and the extension tray 32 do not move relative to each other with application of the force smaller than the biasing force of the resilient member, thereby suppressing the extension tray 32 from rattling with respect to the main tray 31.

Moreover, according to the second modification, the resilient force of the resilient member is smaller than the force required for the drawing portions 39 to draw the main tray 31 into the accommodating portion 16 from the first position to the second position. Thus, irrespective of presence of the resilient member, the main tray 31 can reliably be drawn into the second position.

Third Modification

In the above-described embodiment, the moving portions 41 are bent by resilient deformation. However, the moving portions 41 may be moved by any factor other than the resilient deformation as long as the moving portions 41 can move the abutting portions 40 in the left-right direction 9. For example, one of the moving portions 41 may be provided on a right side of the right surface 34 of the left frame 52 and connected to the right surface 34 through a spring, and the other one of the moving portions 41 may be provided on a left side of the left surface 33 of the right frame 51 and connected to the left surface 33 through a spring.

Fourth Modification

In the above-described embodiment, the difference between the width W3 of the protrusion 98 and the width W1 of the engagement receiving portion 37 corresponds to a distance that the main tray 31 can be moved relative to the extension tray 32 in a state where the extension tray 32 is inserted into the main tray 31 and locked to the main tray 31. However, the relative forward movement in the front-rear direction 8 may be restricted by the protrusion 98 and the engagement receiving portion 37, while the relative rearward movement in the front-rear direction 8 may be restricted by other members. That is, in order to achieve a locked state between the extension tray 32 and the main tray 31, a front end of the protrusion 98 and a front end of the engagement receiving portion 37 may be made to abut against each other to restrict the forward movement of the extension tray 32 relative to the main tray 31, and another member of the extension tray 32 other than the protrusion 98 and another member of the main tray 31 other than the engagement receiving portion 37 may be made to abut against each other to restrict the rearward movement of the extension tray 32 relative to the main tray 31. In this case, a travel distance of the extension tray 32 when the extension tray 32 is moved relative to the main tray 31 from a position at which the front end of the protrusion 98 and the front end of the engagement receiving portion 37 abut against each other to a position at which another member of the extension tray 32 other than the protrusion 98 and another member of the main tray 31 other than the engagement receiving portion 37 abut against each other corresponds to the above-mentioned distance that the main tray 31 can be moved relative to the extension tray 32 in a state where the extension tray 32 is inserted into the main tray 31 and locked to the main tray 31.

As a matter of course, contrary to the above, the relative rearward movement in the front-rear direction 8 may be restricted by the protrusion 98 and the engagement receiving portion 37, while the relative forward movement in the front-rear direction 8 may be restricted by other members.

Fifth Modification

In the above-described embodiment, the extension tray abutment portions 47 abuts against the corresponding extension tray stop portions 45 when the main tray 31 is located on or between the first and second positions. However, this is not be applied when the multifunction device 10 has such a configuration that the main tray 31 can be moved rearward of the second position at which the recording sheet 12 can be fed to the conveying path 65. That is, when the main tray 31 can be inserted rearward of the second position and can be automatically returned to the second position by a damper or the like, the extension tray abutment portions 47 may abut against the corresponding extension tray stop portions 45 when the main tray 31 is moved rearward of the second position.

While the present invention has been described in detail with reference to the embodiments thereof, it would be apparent to those skilled in the art that various changes and modifications may be made therein without departing from the spirit of the present invention.

What is claimed is:

1. An image recording apparatus comprising:

a casing defining an accommodating portion therein and having an opening through which the accommodating portion is open to an outside;

a sheet tray configured to be inserted into the accommodating portion in an inserting direction through the opening and to be pulled out from the accommodating portion in a pulling direction opposite to the inserting direction through the opening, the sheet tray comprising:

a main tray configured to support a recording sheet, the main tray being configured to be positioned at a first position and at a second position as a result of movement of the main tray in the inserting direction, the main tray having an upstream portion in the inserting direction; and an extension tray configured to be moved relative to the main tray in the inserting direction and in the pulling direction, the extension tray being configured to be pulled out from the upstream portion to support a recording sheet in combination with the main tray;

a recording section configured to record an image on a recording sheet fed from the sheet tray;

a drawing portion configured to draw the main tray from the first position into the second position, the second position being located downstream of the first position in the inserting direction and allowing the recording sheet supported at the sheet tray to be fed to the recording section; and a first stop portion disposed in the accommodating portion and configured to abut against the extension tray in a state where the main tray is located at a position downstream of the first position in the inserting direction to restrict movement of the extension tray in the inserting direction.

2. The image recording apparatus as claimed in claim 1, wherein the extension tray has an engaging portion;

wherein the main tray has an engaged portion engageable with the engaging portion;

wherein at least one of the engaging portion and the engaged portion is configured to be moved to allow remaining one of the engaging portion and the engaged portion to be engaged with and disengaged from the at least one of the engaging portion and the engaged portion, the at least one of the engaging portion and the engaged portion being further configured to be moved relative to the remaining one of the engaging portion and the engaged portion in the inserting direction by a first distance in a state where the engaging portion and the engaged portion are engaged with each other, and wherein the first position and the second position define a second distance therebetween, the first distance being greater than the second distance.

3. The image recording apparatus as claimed in claim 2, further comprising a second stop portion configured to abut against the main tray located at the second position to restrict further movement of the main tray in the inserting direction, wherein the casing has an inner wall defining the accommodating portion;

wherein the drawing portion comprising:

an abutting portion protruding from the inner wall in a perpendicular direction perpendicular to the inserting direction and configured to abut against the sheet tray, the abutting portion having an upstream end, a peak end, and a downstream end in the inserting direction, the abutting portion having a first guide surface and a second guide surface, the first guide surface extending from the upstream end to the peak end and being inclined such that the peak end is farther from the inner wall than the upstream end from the inner wall in the perpendicular direction, the second guide surface extending from the peak end to the downstream end and being inclined such that the peak end is farther from the inner wall than the downstream end from the inner wall in the perpendicular direction, the peak end and the downstream end defining a third distance therebetween in the inserting direction, the second distance being smaller than the third distance;

a moving portion configured to move the abutting portion in the perpendicular direction; and an abutted portion provided at the main tray and configured to abut against the abutting portion.

4. The image recording apparatus as claimed in claim 3, wherein the moving portion is supported to the inner wall and resiliently deformably movable relative to the inner wall, the abutting portion directly protruding from the moving portion.

5. The image recording apparatus as claimed in claim 1, wherein the extension tray having an upstream portion in the inserting direction at which a holding portion is provided, the holding portion being configured to be held by a user to move the sheet tray.

6. The image recording apparatus as claimed in claim 1, further comprising a discharge tray disposed above the extension tray and configured to support a recording sheet on which an image has been recorded by the recording section, wherein the extension tray has a positioning portion configured to allow the discharge tray to be subjected to positioning relative to the extension tray.

7. The image recording apparatus as claimed in claim 1, further comprising a plurality of outer covers attached to the casing to cover the casing, one of the plurality of outer covers being attached to a part of the casing located at a side where the opening is formed and having an upstream surface in the inserting direction, wherein the extension tray has an upstream surface in the inserting direction, the upstream surface of the extension tray being flush with the upstream surface of the one of the plurality of outer covers in a state where the first stop portion restricts movement of the extension tray in the inserting direction.

8. The image recording apparatus as claimed in claim 1, further comprising a plurality of outer covers attached to the casing to cover the casing and having outer surfaces, wherein the first stop portion being disposed inward of the outer surfaces.

9. The image recording apparatus as claimed in claim 1, wherein the first stop portion comprises a wall having a surface, the surface being contained in an imaginary plane intersecting the inserting direction.

10. The image recording apparatus as claimed in claim 1, wherein the extension tray has an abutment portion configured to abut against the first stop portion.

11. The image recording apparatus as claimed in claim 10, wherein the first stop portion has an abutting surface configured to abut against the abutment portion, the casing having an upstream surface in the inserting direction, the extension tray having an upstream surface in the inserting direction, the abutting surface and the upstream surface of the casing defining a fourth distance therebetween in the inserting direction, the abutment portion and the upstream surface of the extension tray defining a fifth distance therebetween in the inserting direction, the fourth distance being equal to the fifth distance.

12. The image recording apparatus as claimed in claim 10, wherein the extension tray having a lower surface, the abutment portion protruding downward from the lower surface.

13. The image recording apparatus as claimed in claim 10, wherein the extension tray having a side surface, the abutment portion protruding outward from the side surface in a perpendicular direction perpendicular to the inserting direction.

14. The image recording apparatus as claimed in claim 1, wherein the extension tray has an upstream portion in the inserting direction, the casing having an inner wall defining the accommodating portion, the image recording apparatus further comprising a tray cover attached to the upstream portion of the extension tray, the tray cover having an end portion in a perpendicular direction perpendicular to the inserting direction at which a projection is provided, the projection protruding from the end portion outward of the extension tray in the perpendicular direction, the projection being resiliently deformable in the perpendicular direction and being in pressure contact with the inner wall when the extension tray has been inserted into the accommodating portion.

* * * * *